US008753062B2

(12) United States Patent
Curotto

(10) Patent No.: US 8,753,062 B2
(45) Date of Patent: Jun. 17, 2014

(54) GRIPPER SYSTEM

(75) Inventor: John Michael Curotto, Sonoma, CA (US)

(73) Assignee: The Curotto-Can, LLC, Chattanooga, TN (US)

( * ) Notice: Subject to any disclaimer, the term of this patent is extended or adjusted under 35 U.S.C. 154(b) by 65 days.

(21) Appl. No.: 12/688,615

(22) Filed: Jan. 15, 2010

(65) Prior Publication Data

US 2010/0183410 A1 Jul. 22, 2010

Related U.S. Application Data

(60) Provisional application No. 61/145,330, filed on Jan. 16, 2009, provisional application No. 61/294,651, filed on Jan. 13, 2010.

(51) Int. Cl.
*B65F 3/04* (2006.01)

(52) U.S. Cl.
USPC ..... 414/408; 294/106; 294/198; 414/555

(58) Field of Classification Search
CPC ..... B65F 3/041; B65F 2003/0226; B65F 2003/0233; B66C 3/005
USPC ..... 414/408, 555, 736; 294/192, 198
See application file for complete search history.

(56) References Cited

U.S. PATENT DOCUMENTS

| | | | | |
|---|---|---|---|---|
| 2,069,499 | A | | 2/1937 | Marin et al. |
| 3,112,834 | A | * | 12/1963 | Dempster et al. ..... 414/420 |
| 3,321,036 | A | | 5/1967 | Keenan et al. |
| 4,042,137 | A | | 8/1977 | Hughes et al. |
| 4,143,451 | A | | 3/1979 | Craig et al. |
| 4,152,979 | A | | 5/1979 | Schmidt |
| 4,175,903 | A | | 11/1979 | Carson |
| 4,575,300 | A | | 3/1986 | George |
| 4,580,940 | A | | 4/1986 | Sheaves |
| 4,631,777 | A | | 12/1986 | Takimoto |
| 4,687,405 | A | | 8/1987 | Olney |
| 4,722,270 | A | | 2/1988 | Wall |
| 4,726,726 | A | | 2/1988 | Dossena et al. |
| 4,889,462 | A | | 12/1989 | Naab et al. |
| 5,002,450 | A | | 3/1991 | Naab |
| 5,007,786 | A | | 4/1991 | Bingman |
| 5,105,967 | A | | 4/1992 | Horpestad |
| 5,119,894 | A | | 6/1992 | Crawford et al. |
| 5,135,129 | A | | 8/1992 | Joly |
| 5,209,312 | A | | 5/1993 | Jensen |
| 5,230,393 | A | | 7/1993 | Mezey |
| 5,244,109 | A | | 9/1993 | Mullett et al. |

(Continued)

FOREIGN PATENT DOCUMENTS

| | | | | |
|---|---|---|---|---|
| EP | 0860380 B1 | * | 2/2001 | ..... B65F 3/041 |
| GB | 2082142 A | * | 3/1982 | ..... B65F 3/041 |

OTHER PUBLICATIONS

Curotto, John Michael, "Curotto Scale System Project", Dec. 1, 2008, 12 pgs.

*Primary Examiner* — James Keenan

(57) ABSTRACT

The disclosure describes a novel approach of utilizing a front loading waste collection vehicle. A gripper system is added to the fork tube of a front loading waste collection vehicle. The gripper system allows a front loader to lift and dump waste bins into the truck's hopper for the collection of trash, recyclables and/or other materials.

20 Claims, 10 Drawing Sheets

(56) References Cited

U.S. PATENT DOCUMENTS

| | | | | | |
|---|---|---|---|---|---|
| 5,265,311 | A | | 11/1993 | Gard | |
| 5,266,000 | A | * | 11/1993 | LeBlanc, Jr. | 414/408 |
| 5,415,314 | A | | 5/1995 | McCollum | |
| 5,447,405 | A | | 9/1995 | Bayne et al. | |
| 5,565,846 | A | | 10/1996 | Geiszler et al. | |
| 5,641,947 | A | | 6/1997 | Riddle, Jr. | |
| 5,784,947 | A | | 7/1998 | Bayne et al. | |
| 5,807,056 | A | | 9/1998 | Osborn et al. | |
| 5,826,485 | A | | 10/1998 | Bayne et al. | |
| 5,837,945 | A | | 11/1998 | Cornwell et al. | |
| 6,027,299 | A | * | 2/2000 | Williams | 414/408 |
| 6,139,244 | A | * | 10/2000 | VanRaden | 414/408 |
| 6,167,795 | B1 | | 1/2001 | Bayne et al. | |
| 6,191,691 | B1 | | 2/2001 | Serrault | |
| 6,224,317 | B1 | * | 5/2001 | Kann et al. | 414/408 |
| 6,422,800 | B1 | * | 7/2002 | Reichow et al. | 414/408 |
| 6,687,656 | B2 | | 2/2004 | Durbin et al. | |
| 6,761,414 | B1 | | 7/2004 | Broberg | |
| 6,773,054 | B2 | | 8/2004 | Martini | |
| 6,821,074 | B2 | * | 11/2004 | Schreiber et al. | 414/408 |
| 6,863,249 | B1 | | 3/2005 | Alvord | |
| 7,000,289 | B2 | | 2/2006 | Cedrone | |
| 7,146,294 | B1 | | 12/2006 | Waitkus, Jr. | |
| 7,151,231 | B2 | | 12/2006 | Kamakau | |
| 7,210,890 | B2 | | 5/2007 | Curotto et al. | |
| 7,347,657 | B2 | * | 3/2008 | Brunn | 414/408 |
| 7,390,159 | B2 | * | 6/2008 | Rimsa et al. | 414/408 |
| 7,396,996 | B1 | | 7/2008 | Shotey et al. | |
| 7,633,020 | B2 | * | 12/2009 | Santi et al. | 177/136 |
| 7,737,372 | B2 | | 6/2010 | Dougherty et al. | |
| 7,897,884 | B2 | | 3/2011 | Harish | |
| 8,330,059 | B2 | | 12/2012 | Curotto | |
| 2005/0095096 | A1 | * | 5/2005 | Curotto et al. | 414/406 |
| 2006/0127202 | A1 | | 6/2006 | Tryggvason | |
| 2007/0278019 | A1 | | 12/2007 | Santi et al. | |
| 2010/0206642 | A1 | | 8/2010 | Curotto | |
| 2010/0281654 | A1 | | 11/2010 | Curotto | |
| 2011/0038696 | A1 | * | 2/2011 | Ummel, Jr. | 414/408 |
| 2011/0188976 | A1 | * | 8/2011 | Rowland et al. | 414/408 |
| 2011/0266296 | A1 | | 11/2011 | Curotto | |
| 2012/0273498 | A1 | | 11/2012 | Curotto | |

* cited by examiner

GRIPPER SYSTEM

RELATED APPLICATIONS

This application claims the benefit of U.S. Provisional Application No. 61/145,330, filed Jan. 16, 2009, and entitled, "Gripper System", which application is hereby incorporated herein by reference. This application also claims the benefit of U.S. Provisional Application No. 61/294,651, filed Jan. 13, 2010, and entitled, "Gripper System", which application is hereby incorporated herein by reference.

INTRODUCTION

Several types of waste collection vehicles exist. Waste collection vehicles can be front loaders, rear loaders, automated side loaders, pneumatic collection, and grapple trucks. Waste collection vehicles are typically utilized to pick up quantities of waste for hauling to a determined area, such as a landfill, transfer station, or material recovery facility. Waste collection vehicles can be further utilized or modified to collect recyclables for transport to a recycling facility.

The allocation of waste removal equipment has been improved by the use of large trucks having compaction capabilities extending their effective range and capacity between unloadings. Further, the vehicles can include specialized hoists to lift trash containers into the truck.

Front loaders are designed to service commercial and industrial businesses by being adapted to load commercial waste containers, such as dumpsters. Front loaders are typically equipped with a fork assembly on the front end of the vehicle designed to engage standardized waste containers. The forks are aligned with and inserted into pockets provided on the waste container. The fork assembly then lifts the commercial waste container over the vehicle and dumps the material into a hopper of the vehicle.

SUMMARY

The disclosure describes a novel approach of utilizing a front loading waste collection vehicle. A gripper system is added to the fork tube of a front loading waste collection vehicle. The gripper system allows a front loader to lift and dump waste bins into the truck's hopper for the collection of trash, recyclables and/or other materials.

In part, this disclosure describes a method for automatically emptying a waste bin with a front loading waste collection vehicle. The method includes performing the following steps:

a) positioning a waste bin at least partially between two forks of a fork assembly on the front loading waste collection vehicle;

b) activating a gripper system, the step of activating the gripper system causing at least two opposite arms of the gripper system to move towards each other until each of the at least two opposite arms contacts the waste bin;

c) lifting the fork assembly, the gripper system, and the waste bin held by the gripper system;

d) emptying material contained in the waste bin into a hopper of the front loading waste collection material vehicle;

e) lowering the fork assembly, the gripper system, and the waste bin held by the gripper system; and f) retracting the at least two opposite arms of the gripper system to release the waste bin.

Another aspect of this disclosure describes a front loading waste collection vehicle that includes: a hopper attached to a vehicle; a fork assembly attached to the vehicle opposite the hopper; and an automated gripper system attached to the fork assembly. The gripper system includes: a mounting plate adapted to attach to a fork tube of the fork assembly; a frame adapted to attach to the mounting plate; and at least two opposite movable arms attached to the frame, each of the at least two opposite movable arms comprising belting attached to a side opposite the fork tube.

Yet another aspect of this disclosure describes an automated gripper system that includes: a mounting plate adapted to attach to a fork tube of a fork assembly of a front loading waste collection vehicle; a frame adapted to attach to the mounting plate; and at least two opposite movable arms attached to the frame, each of the at least two opposite movable arms comprising belting attached to a side opposite the fork tube.

These and various other features as well as advantages will be apparent from a reading of the following detailed description and a review of the associated drawings. Additional features are set forth in the description that follows and, in part, will be apparent from the description, or may be learned by practice of the described embodiments. The benefits and features will be realized and attained by the structure particularly pointed out in the written description and claims hereof as well as the appended drawings.

It is to be understood that both the foregoing general description and the following detailed description are exemplary and explanatory and are intended to provide further explanation of the claimed invention.

DETAILED DESCRIPTION

Figure 1:
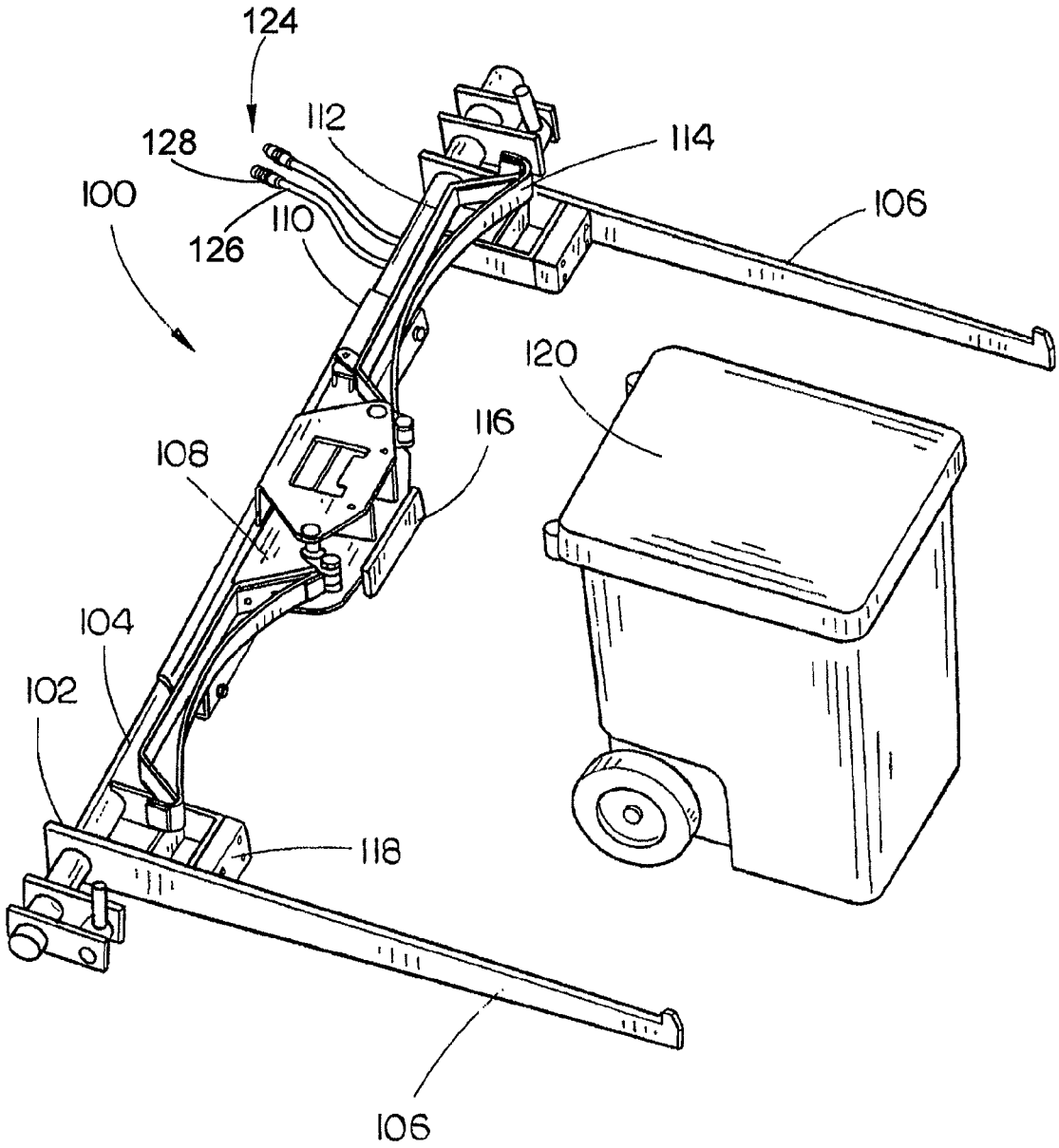
FIG. 1 is an isometric view of one embodiment of a gripper system according to the principles of the present disclosure.

One aspect of the present disclosure relates to an automated gripper system for gripping waste bins and dumping them into the hopper of a waste collection truck. The gripper system is referred to as automated because the grabbing, lifting, dumping, and setting down of the waste bin by the gripper system may be performed automatically upon the initiation of the actions by an operator command.

In an embodiment, the automated gripper system comprises a mounting plate, two movable arms, a bumper, belting, and a frame. The gripper system is mountable to the fork tube of a front loading waste collection vehicle 101. The gripper system allows a front loader to lift and dump waste bins into the truck's hopper for the collection of trash and/or recyclables.

Reference will now be made in detail to various features of the present disclosure that are illustrated in the accompanying drawings. Wherever possible, the same reference numbers will be used throughout the drawings to refer to the same or like parts.

FIGS. 1 through 5 illustrate embodiments of a gripper system 100 for a front loading waste collection vehicle 101. The gripper system 100 attaches to a fork assembly 102. In one embodiment, the gripper system 100 attaches to the fork tube 104 of a fork assembly 102. The fork assembly 102 further comprises two forks 106. The two forks 106 of the fork assembly 102 may be inserted into the pockets of commercial waste containers for automated emptying of the commercial waste containers (or dumpsters). In one embodiment, the fork assembly 102 can be referred to as automated because the movement of the fork assembly can be automated or partially automated. The fork assembly 102 typically comprises two bumpers 118 mounted to the fork tube 104 and/or forks 106 of the fork assembly 102. The bumpers 118 cushion or reduce the impact of the commercial waste container on the fork assembly 102 as the commercial waste container is received and lifted by the fork assembly 102. The bumpers 118 can be made of any suitable material known in the art, such as plastic and rubber. The fork assembly 102 can utilize a hydraulic system or a pneumatic system 122 to lift the fork assembly 102. The hydraulic system 122 utilizes a hydraulic cylinder(s) and hydraulic fluid, such as oil, to lift the fork assembly 102. The pneumatic system 122 utilizes a pneumatic cylinder(s) and compressed gas, such as air, to move/operate/actuate the fork assembly 102.

Commercial waste containers are typically sized to hold from about 1 cubic yard (about 0.7646 cubic meters) to about 10 cubic yards (about 7.646 cubic meters) of waste. Front loaders are not designed for the automated lifting of smaller sized waste containers or waste bins 120. Waste bins 120 typically hold from about 25 gallons (about 94.64 liters) to about 400 gallons (about 1514.2 liters) of waste. In one embodiment, the gripper system 100 allows a front loading waste collection vehicle 101 to automatically load and empty waste bins 120. In another embodiment, the gripper system 100 allows a front loading waste collection vehicle 101 to automatically load and empty waste bins 120 with a minimum height of at least 6 inches (15.24 centimeters). In an additional embodiment, the automated gripper system grabs, lifts, and disposes of any type/shape of waste bins 120 or any other disposed items, such as furniture, appliances, barrels, or crates. The gripper system 100 allows one waste collection vehicle 101 to be sent to an area for the collection of both commercial waste containers and waste bins 120. Previously, two separate waste collection vehicles 101 would be needed to collect both commercial waste containers and waste bins 120.

The gripper system 100 comprises a mounting plate 110, two movable opposing arms 112, a bumper 116, belting 114, and a frame 108. In one embodiment, the gripper system 100 weighs between about 150 pounds (about 68.04 kilograms) to about 270 pounds (about 122.5 kilograms). In another embodiment the gripper system 100 weighs about 220 pounds (about 99.79 kilograms). In one embodiment the gripper system 100 is suitable for lifting about 600 pounds (about 272.2 kilograms) or less. In another embodiment, the gripper system 100 is suitable for lifting about 500 pounds (about 226.8 kilograms) or less. In another embodiment, the gripper system 100 is suitable for lifting about 1000 pounds (about 453.6 kilograms) or less. In another embodiment, the gripper system 100 is suitable for lifting about 2000 pounds (about 907.2 kilograms) or less.

In one embodiment, the gripper system 100 is positioned behind the bumpers 118 and between the bumpers 118 and fork tube 104 of the fork assembly 102. Because the gripper system 100 is positioned behind the bumpers 118, in this embodiment, the gripper system 100 does not affect the ability of the fork assembly 102 to receive and pick up commercial waste containers.

The gripper system 100 can be attached to the fork assembly 102 in several different ways. In one embodiment, the gripper system 100 is attached to the front of the fork tube 104 of the fork assembly 102. In another embodiment, the gripper system 100 is mounted on the top of the fork tube 104. In an alternative embodiment, the gripper system 100 is mounted to the bottom of the fork tube 104. In yet another embodiment, the gripper system 100 is attached directly to the hydraulic or pneumatic lifting system 122.

In the embodiment shown in FIG. 1, the gripper system 100 is attached to the fork tube 104 by utilizing a mounting plate 110. The mounting plate 110 is designed to fit partially around and/or closely abut the fork tube 104. The mounting plate 110 is attached to the fork tube 104. The mounting plate 110 can be attached to the fork tube 104 by welding, bolting, and/or soldering. The mounting plate 110 is further designed to receive the frame 108. The frame 108 of the gripper system 100 is attached to the mounting plate 110. The frame 108 can be attached to the mounting plate 110 in several different ways. In one embodiment, the frame 108 is bolted, welded, and/or soldered to the mounting plate 110.

In one embodiment, the frame 108 has a height of about 6 inches (about 15.24 centimeters) to about 15 inches (about 38.1 centimeters). In another embodiment, the frame 108 has a height of about 9.75 inches (about 24.76 centimeters) to about 11.75 inches (about 29.84 centimeters). In a further embodiment, the frame 108 has a height about 10.75 inches (about 27.31 centimeters). It is appreciated that the frame 108 can be any height suitable for attaching to the mounting plate 110 without departing from the scope and intent of the present disclosure.

In one embodiment, the frame 108 and the mounting plate 110 have a depth of about 10 inches (about 25.4 centimeters) to about 15 inches (about 38.1 centimeters). In another embodiment, the frame 108 and the mounting plate 110 have a depth of about 12.00 inches (about 30.48 centimeters) to about 13.50 inches (about 34.29 centimeters). In a further embodiment, the frame 108 and the mounting plate 110 have a height of about 12.75 inches (about 32.38 centimeters). It is understood that the frame 108 and the mounting plate 110 can have any depth suitable for attaching to the fork tube 104 without departing from the scope and intent of the present disclosure.

In one embodiment, the frame 108 comprises a bumper 116. In an embodiment, the depth of the gripper system 100, which is measured from the bumper 116 to the fork tube 104, is from about 9.75 inches (about 24.76 centimeters) to about 14.75 inches (about 37.46 centimeters). In another embodiment, the depth of the gripper system 100 is about 12.75 inches (about 32.38 centimeters).

The bumper 116 of the frame 108 cushions or reduces the impact of a waste bin 120 on the fork assembly 102 and the gripper system 100 when it is received/loaded and/or lifted by the fork assembly 102. In one embodiment the bumper 116 is positioned behind bumpers 118 so that bumper 116 does not contact the commercial waste containers loaded on the fork assembly 102. In yet another embodiment, the bumper 116 is at the same position as bumpers 118 so that the bumper 116 does cushion the impact of the commercial waste containers loaded on the fork assembly 102. In one embodiment, the bumper 116 is made of the same material as the fork assembly's bumpers 118. In another embodiment, the bumper 116 is made of different material from the fork assembly's bumpers 118. The bumper 116 can be made of any suitable material known in the art, such as plastic and rubber.

In another embodiment, the gripper system 100 comprises a suitable mechanism for securely holding a waste bin 120, such as a movable claw, clasp, arms, or looping system. In one embodiment, gripper system 100 further comprises two movable arms 112. In one embodiment, each of the movable arms 112 is attached to the frame 108 by a moveable joint, such as a hinge, pivot, pin, and/or shaft. In one embodiment, the length of the gripper system 100, which is the distance from one end of one movable arm 112 to the end of the other moveable arm 112, can be from about 50 inches (about 127 centimeters) to about 100 inches (about 254 centimeters). In another embodiment the length of the gripper system 100 is less than the distance between the forks 106 of the fork tube 104. In a further embodiment, the length of the gripper system 100 is greater than the distance between the forks 106 of the fork tube 104 but less than the width of the waste collection vehicle. In one embodiment, the length of the gripper system 100 is from about 74.5 inches (about 189.2 centimeters) to about 78.5 inches (about 199.4 centimeters). In an additional embodiment, the length of the gripper system 100 is about 76.5 inches (about 194.3 centimeters).

In one embodiment, the movable arms 112 are substantially parallel to the fork tube 104 when at rest. The movable arms 112 moves in a linear motion or rotate around an axis towards the ends of the forks 106 and each other. The moveable arms 112 can be made of any suitable materials for securely holding onto a waste bin 120, such as plastic and/or metal.

In one embodiment, each moveable arm 112 further comprises belting 114. In an embodiment, the belting 114 extends substantially across the length of each of the moveable arms 112. The belting 114 can be attached to the moveable arms 112 by any suitable means, such as bolting, gluing, welding, and/or soldering. In another embodiment, the belting 114 runs along one side of each moveable arm 112. In this embodiment, the belting 114 runs along the side of the moveable arm 112 that is opposite the side closest to the fork tube 104 when the moveable arms 112 are in a rest position. The belting 114 is positioned on the movable arms 112 to abut a waste bin 120 when the moveable arms 112 of the gripper system 100 are engaged or activated. In one embodiment, the belting 114 is at least partially composed of rubber. Belting 114 can be made of any suitable material for gripping a waste bin 120, such as steel, elastic, bungee, plastic, rubber, and/or leather. Belting 114 can further be coated with any suitable substance for providing increased friction, grip, and/or resistance between the moveable arms 112 and the waste bin 112. The belting 114 is at least partially flexible and increases the hold/grip of the moveable arms 112 on a waste bin 120 when activated or contracted. The belting 114 is at least partially flexible to provide a secure hold on the waste bin 120 without crushing, scuffing or breaking the waste bin 120 by the moveable arms 112 while contracted. The belting 114 provides extra resistance, friction, and/or grip helping to prevent a waste bin 120 from slipping from the moveable arms 112 when contracted or engaged. In another embodiment, the moveable arms 112 can comprise any other suitable device or mechanism for increasing the grip or resistance of the moveable arms 112 while not crushing the waste bin 120, such as bands, bumpers, cushions, and/or sponges.

Figure 7:
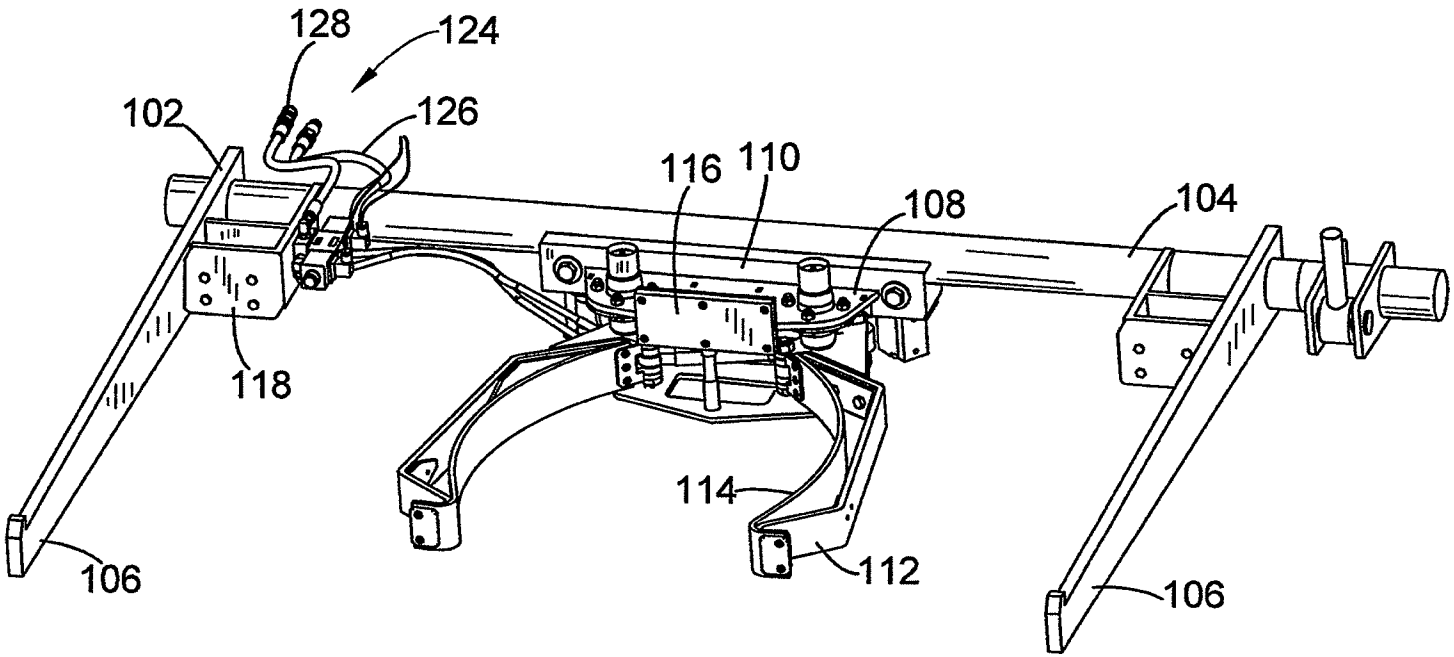
FIG. 7 is an isometric view of one embodiment of a gripper system according to the principles of the present disclosure.

In one embodiment, the arms 112 are designed to be actuated or contracted by a hydraulic, electric, or pneumatic system. The moveable arms 112 can be actuated by a hydraulic or pneumatic cylinder. In one embodiment, the hydraulic cylinder can comprise a 1.50 inch bore, a 7.0 inch stroke, and a 1.0 inch diameter shaft. In one embodiment, the moveable arms 112 are designed to be powered and operated by systems already utilized by the waste collection vehicle 101. For instance, the arms 112 can be powered by the electrical system and the hydraulic system or the pneumatic system 122 of the waste collection vehicle 101 via at least one connector 124. In one embodiment, the connector 124 includes at least one of a hose 126 and a quick coupler 128 as illustrated in FIGS. 1 and 7. In one embodiment, the gripper system 100 can be controlled by the same control system that operates the fork assembly 102. In another embodiment, the gripper system 100 is controlled by a separate control from the fork assembly, which is added to the waste collection vehicle 101. In one embodiment, the control system is mounted on the exterior of the waste collection vehicle 101 and has a switch bank that is accessible by an operator outside of the cab of the waste collection vehicle 101. In another embodiment, the control system is mounted on the interior of the waste collection vehicle 101 and has a switch bank that is accessible by an operator inside of the cab of the waste collection vehicle 101.

In another embodiment, the gripper system 100 is a self powered system and/or a self contained system. For instance, the gripper system can be self contained by utilizing solar power.

One embodiment of a gripper system 100 utilizes the parts and configuration as shown in Provisional Application No. 61/294,651, filed Jan. 13, 2010. As illustrated in Provisional Application No. 61/294,651 and FIGS. 4 and 5, the arms of the gripper system may be attached to each other via a link bar assembly 130. This example is not limiting.

Figure 2A:
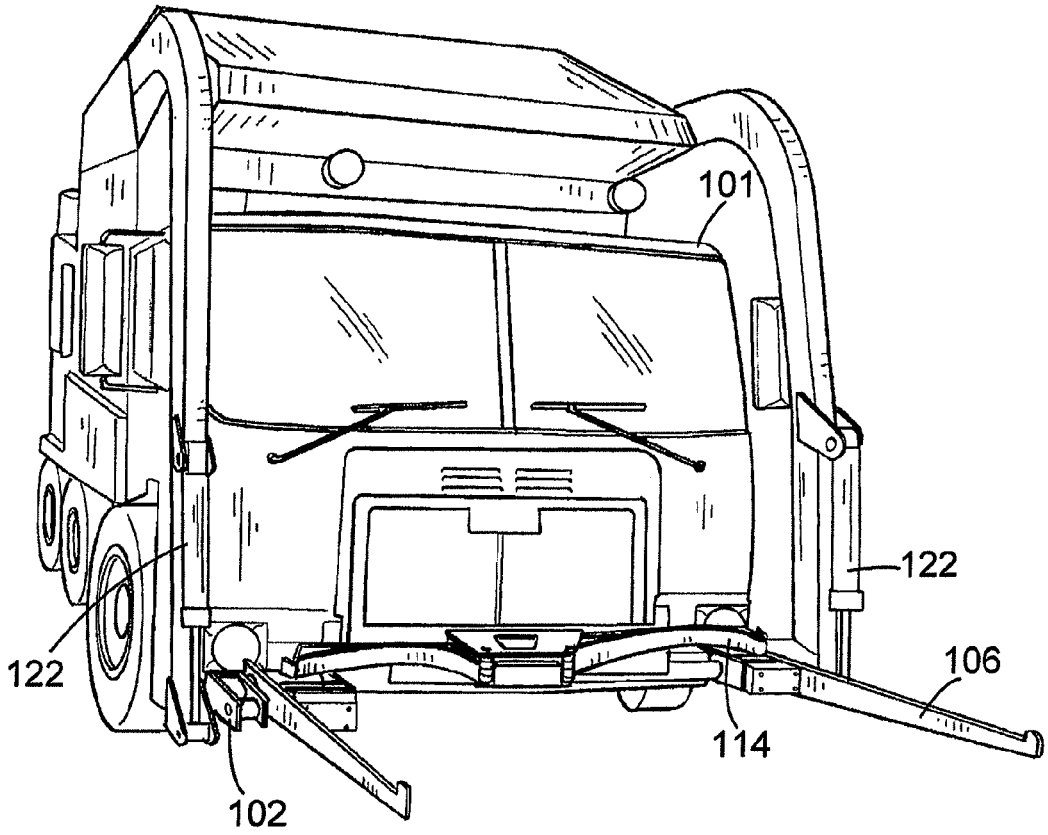
FIG. 2A is a perspective view of one embodiment of a front loader with a fork assembly and a gripper system.

FIGS. 2A, 2B, 2C and 2D illustrate an embodiment of a gripper system. The gripper system 100 allows front loaders to automatically collect waste bins 120. The gripper system 100 remains in a rest position until activated. The rest position is illustrated in FIG. 2A. The gripper system 100, in this embodiment, in the rest position remains between the bumpers 118 and fork tube 104 of the fork assembly 102 or behind the bumpers 118 and does not affect the fork assembly's ability to receive and lift commercial waste containers.

To receive a waste bin 120, the front loading waste collection vehicle is driven up to a waste bin 120. The driver positions the waste bin 120 between the two forks 106 of the fork assembly 102. Once the waste bin 120 is positioned between the two forks 106 of the fork assembly 102, an operator can activate the movable arms 112. In another embodiment, the waste bin 120 is positioned between the forks 106 of the fork assembly 102 at a distance of at most about 24 inches (about 60.96 centimeters) from the bumper 116 of the gripper system 100 before the gripper system 100 is in a position to load the waste bin 120.

The moveable arms 112 close by hydraulic or pneumatic force activated by the operator. The moveable arms 112 move until they impact and/or grasp the waste bin 120. The movable arms 112 and the belting 114 exert enough force on the waste bin 120 so that the waste bin 120 can be lifted without any substantial slippage of the waste bin 120. The positive force exerted by the moveable arms 112, belting 114 and hydraulic or pneumatic system 122 on the waste bin 120 provide for a positive locked grip that substantially prevents waste bins 120 from slipping from the moveable arms 112.

Figure 2B:
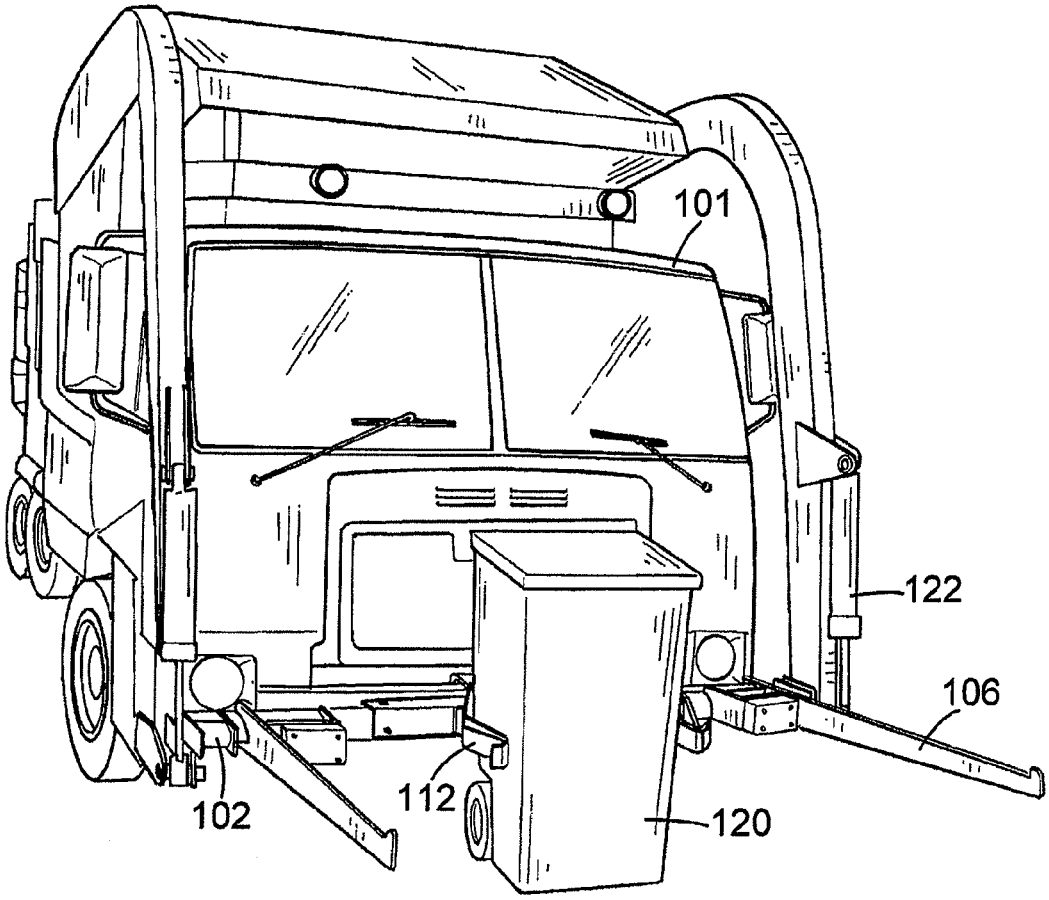
FIG. 2B is a perspective view of a waste bin in the gripper system of FIG. 2A.

The force exerted by the moveable arms 112 is from the hydraulic system or pneumatic system 122, which allows the moveable arms 112 to securely grip the waste bin 120 as illustrated in FIG. 2B. Further, the belting 114 provides for additional hold/grip on the waste bin 120 by providing extra traction and resistance. In one embodiment, the hydraulic system 122 of the waste collection vehicle 101 is capable of exerting about 2000 psi. In another embodiment, the hydraulic system 122 can comprise a 10 US gpm priority flow divider mounted to the packer body of the waste collection vehicle 101. In this embodiment, the flow divider can be activated by container controls and is not continuously activated.

Figure 2C:
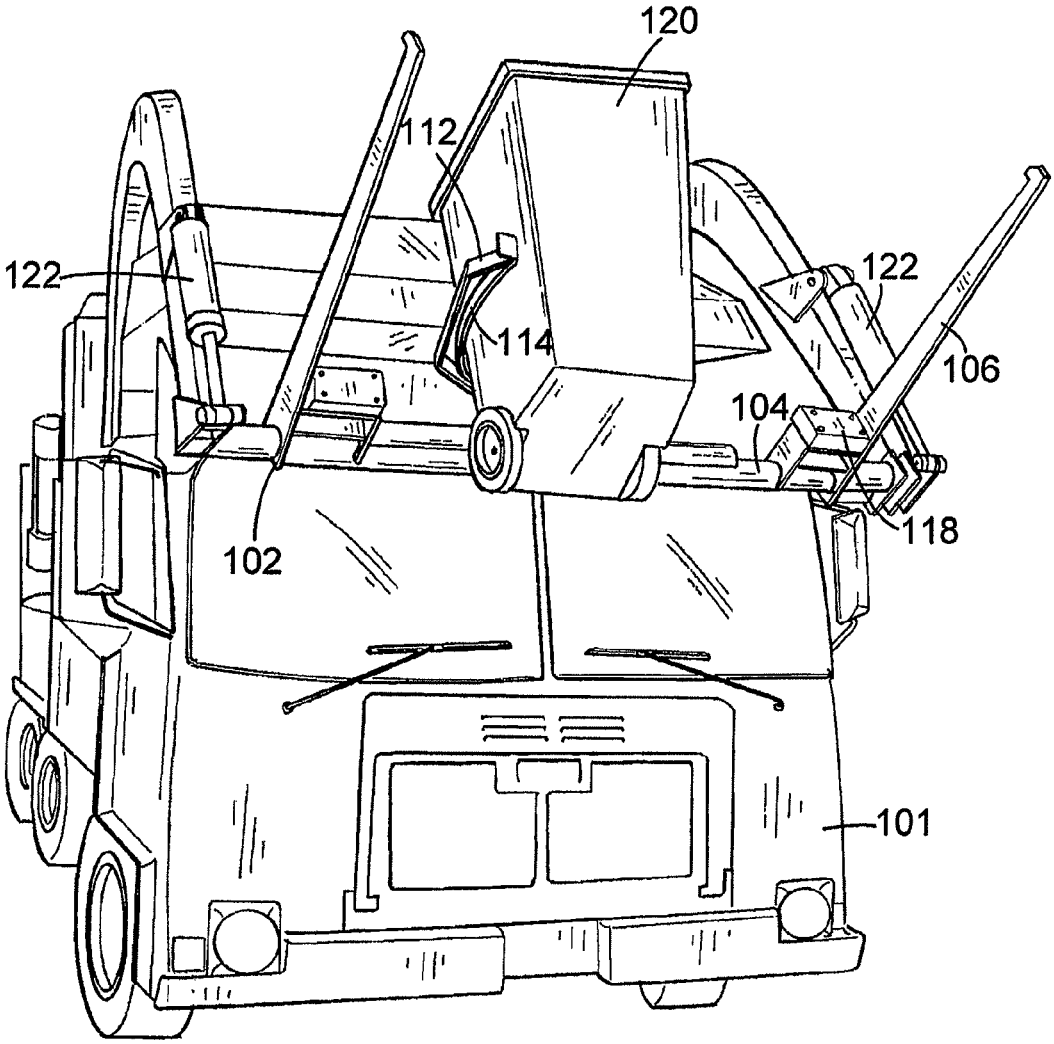
FIG. 2C is a perspective view of the lifting of the fork assembly and the waste bin in the gripper system of FIG. 2B.
Figure 2D:
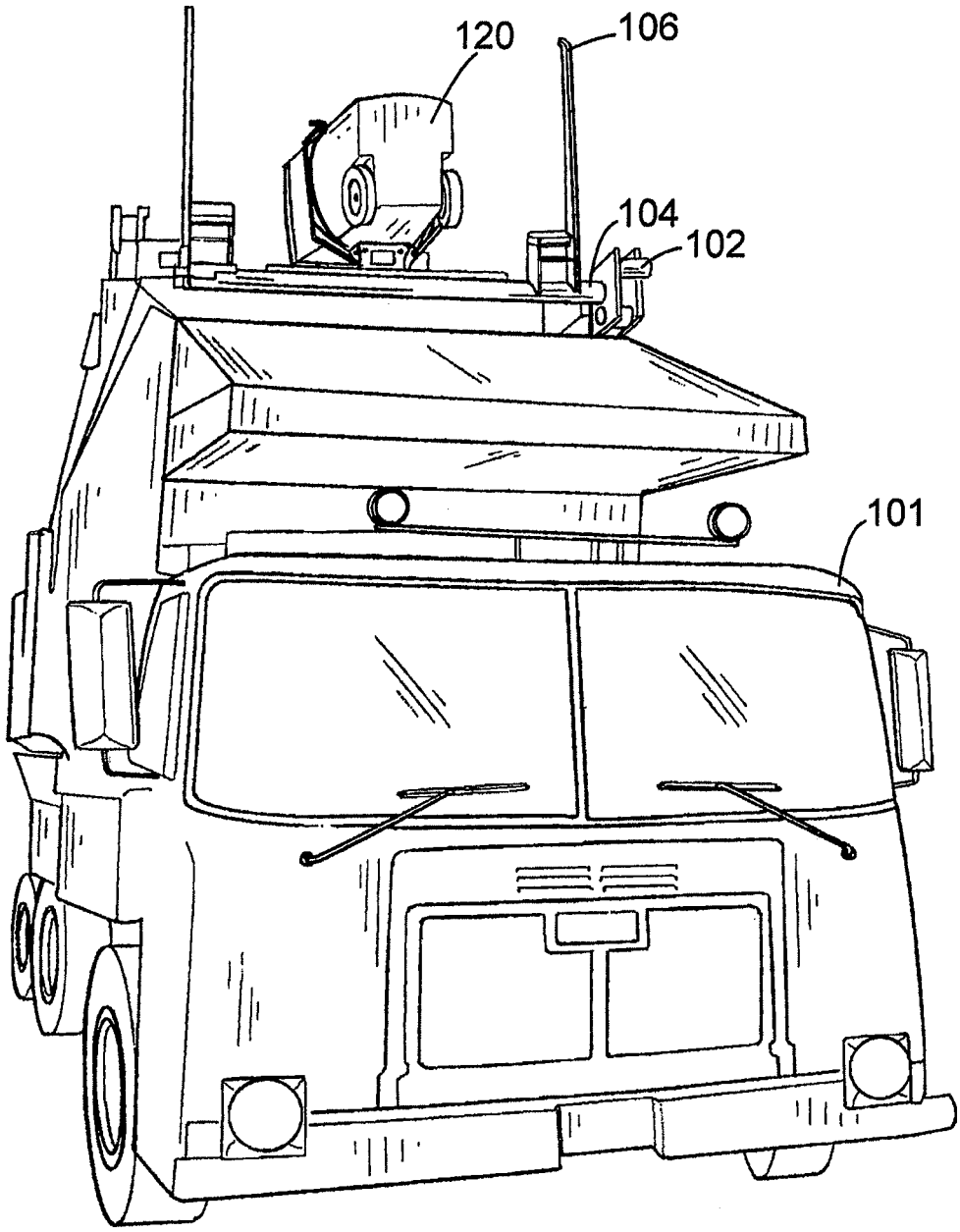
FIG. 2D is a perspective view of the fork assembly and the waste bin in the gripper system being dumped of FIG. 2C.
Figure 3:
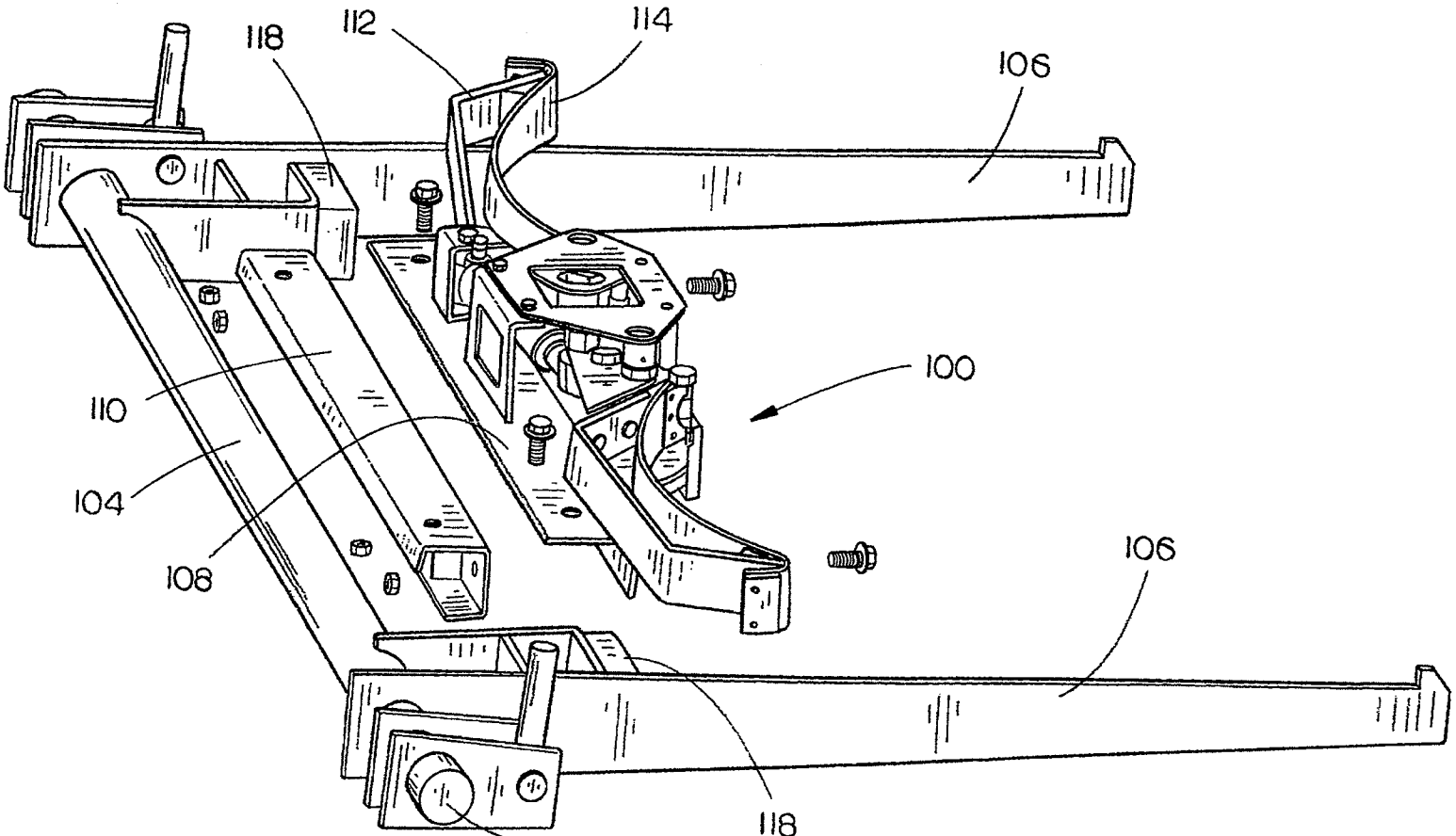
FIG. 3 is an exploded perspective view of one embodiment of a gripper system according to the principles of the present disclosure.
Figure 4:
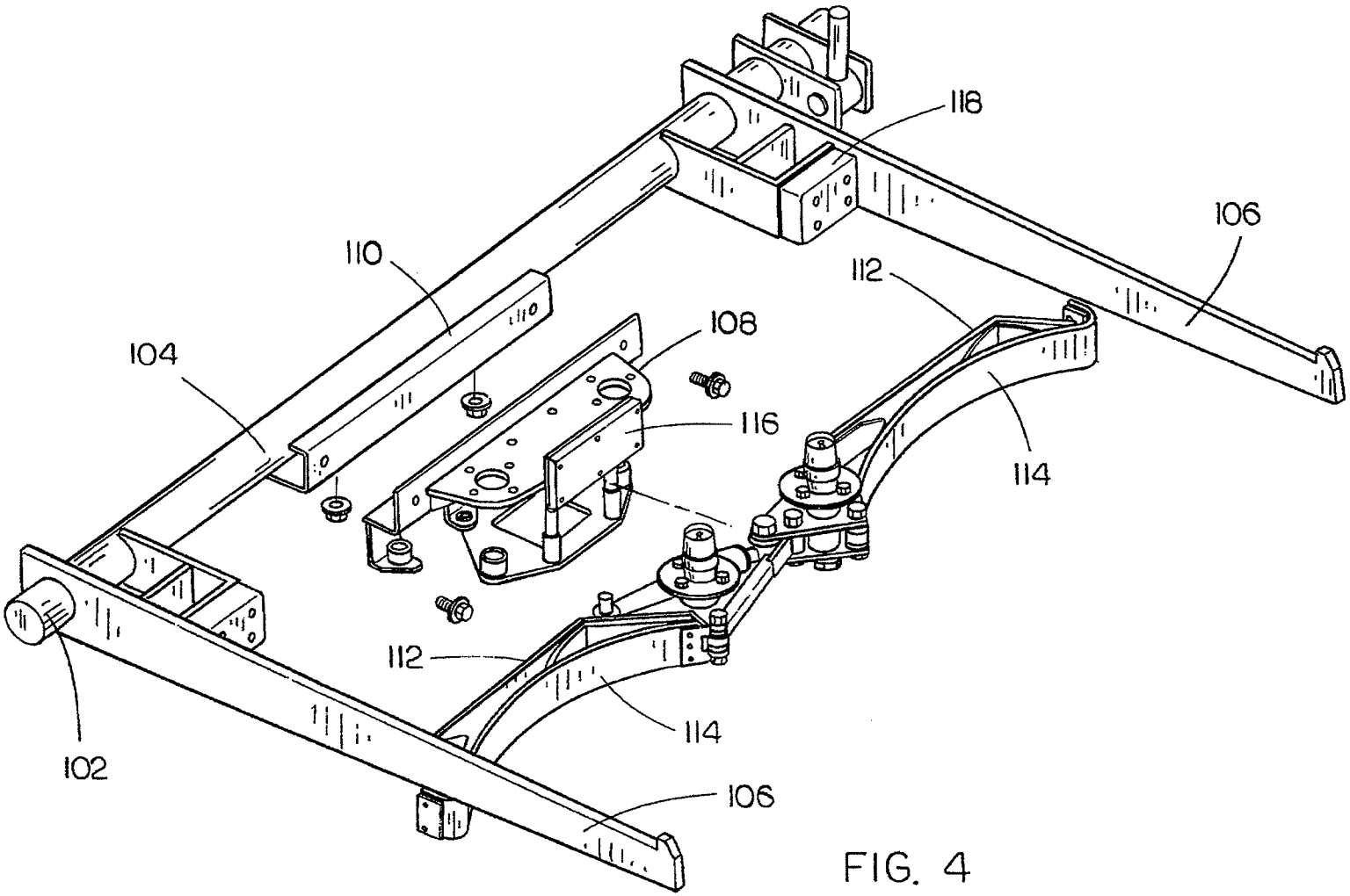
FIG. 4 is an exploded isometric view of one embodiment of a gripper system according to the principles of the present disclosure.
Figure 5:
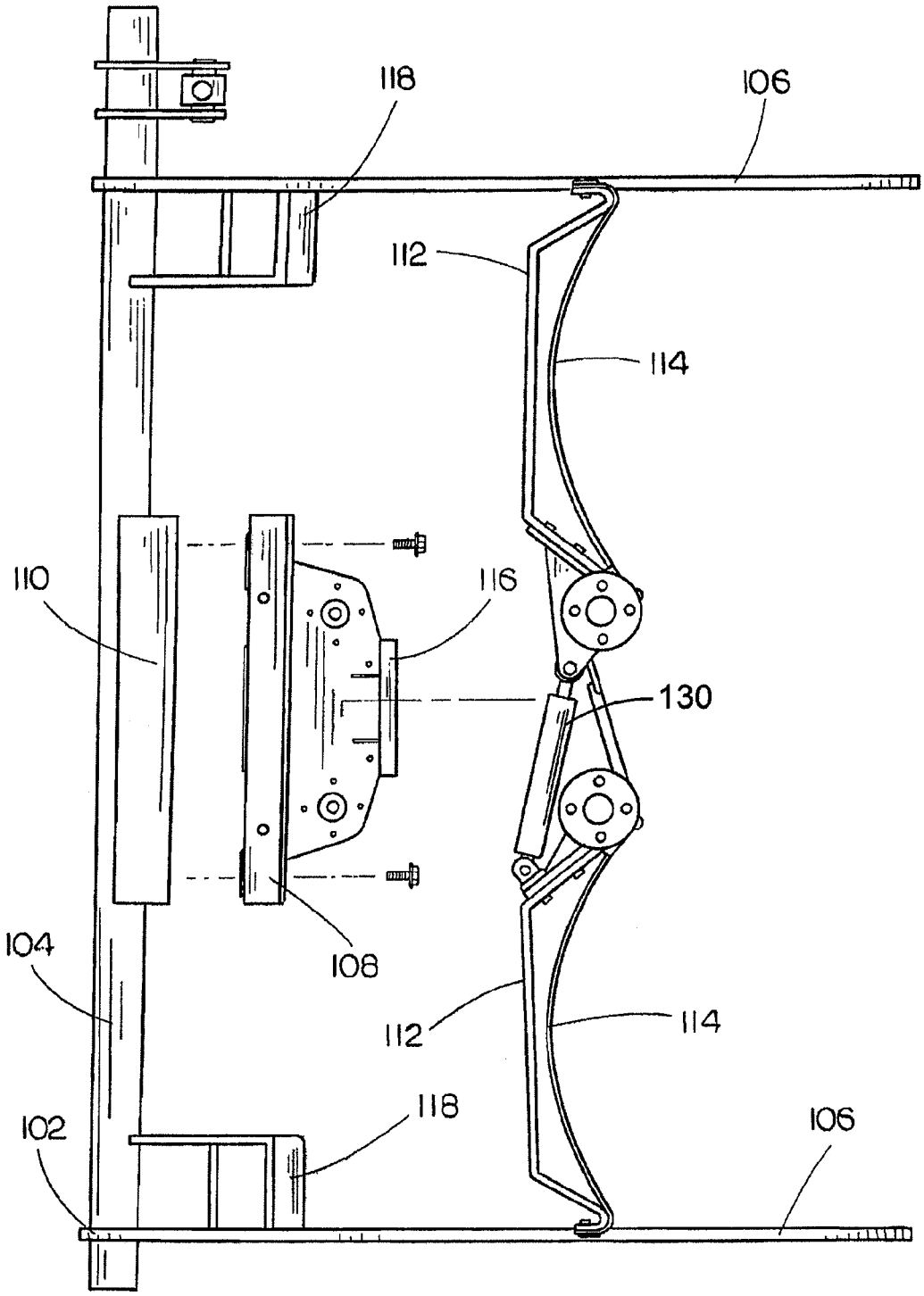
FIG. 5 is an exploded top view of one embodiment of a gripper system according to the principles of the present disclosure.

Once the moveable arms 112 have contracted around the waste bin 120, the fork assembly 102 can be utilized to the lift the waste bin 120. The waste bin 120 is lifted by the fork assembly 102 as illustrated in FIG. 2C. The fork assembly 102 lifts the waste bin 120 until the waste bin 120 is positioned to dump the contents of the waste bin 120 into the hopper of the waste collection vehicle as illustrated in FIG. 2D. Once the contents of the waste collection bin have been emptied into the hopper or as desired, the fork assembly 102 lowers the waste bin 120 back to the ground. After the waste bin 120 has been lowered to the ground by the fork assembly 102, the operator can release the emptied waste bin 120 by moving the two movable arms 112 into the rest position.

Previous systems for adapting a front loading waste collection vehicle 101 to collect waste bins 120 have been designed. However, these previously designed systems often require specialized carts unlike the gripper system. Further, the previous systems often dropped, spilled, and/or damaged the waste bins, especially if the waste bins contained heavy loads. Further, these previous systems often drop waste bins into the hopper of a collection vehicle due to ineffective gripping and holding. If the hoppers of these previous systems have any type of compaction method or blade, the retrieval of the dropped waste bins is undesirable. Additionally, the fork assemblies of previous systems were often difficult to position at correct heights and thereby required manual cart attachment. In contrast, the gripper system 100 is designed to receive/load and lift any type of waste bin 120 or disposed bulky items, such as chair, barrel, or box. Further, utilization of the moveable arms 112 in combination with the belting 114 and the hydraulic or pneumatic system 122 of the waste collection vehicle 101 substantially prevents the gripper system 100 from dropping, spilling, and damaging waste bins 120.

Figure 6:
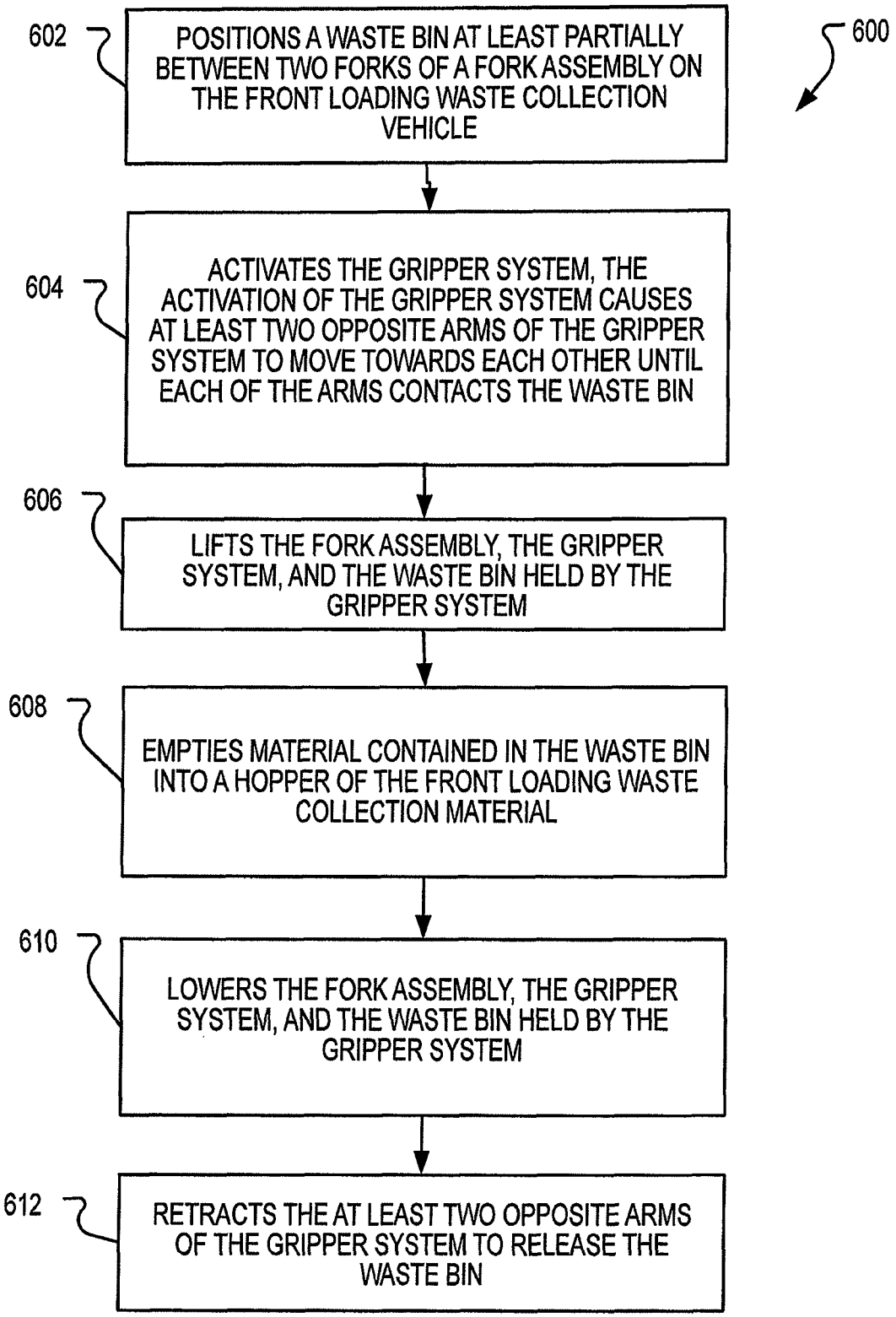
FIG. 6 illustrates an embodiment of a method for automatically emptying a waste bin with a front loading waste collection vehicle.

FIG. 6 represents an embodiment of a method for automatically emptying a waste bin with a front loading waste collection vehicle 600. As illustrated in FIG. 6, method 600 positions a waste bin at least partially between two forks of a fork assembly on the front loading waste collection vehicle 602. The waste bin may be positioned by manually moving the waste bin between the two forks or by driving the front loading WCV up to the waste bin. In one embodiment, an edge of the waste bin is positioned at a distance of at most about 24 inches from a frame of the gripper system. In another embodiment, an edge of the waste bin is positioned at distance of at most about 24 inches from a bumper on the gripper system.

Further, method 600 activates a gripper system. The activation of the gripper system causes at least two opposite arms of the gripper system to move towards each other until each of the arms contacts the waste bin 604. The operator may activate the gripper system through a lever, button, or touch display screen. The two opposite arms may move by utilizing the hydraulic, pneumatic, and/or electrical system from the front loading waste collection vehicle. In one embodiment, the two opposite arms are capable of lifting up to about 2000 pounds and applying a force of up to about 2000 psi.

Method 600 lifts the fork assembly, the gripper system, and the waste bin held by the gripper system 606. The front loading WCV is automated. The activation of the automated system for lifting the fork assembly causes the waste bin and gripper system to lift and move towards the hopper. The amount of force exerted by the two opposite moveable arms and the belting found on the two opposite arms allows the gripper system to lift and empty waste bins without dropping, breaking, or slipping of the waste bins. In other words, the two opposite arms securely hold the waste bin.

As illustrated, method 600 empties material contained in the waste bin into a hopper of the front loading waste collection material vehicle 608. As the fork assembly fully lifted, the waste bin is turned upside down and the contents of the waste bin are expelled into the hopper of the front loading waste collection vehicle.

Method 600 lowers the fork assembly, the gripper system, and the waste bin held by the gripper system 610. In one embodiment, the fork assembly is lowered until the base of the waste bin contacts the ground.

Further, method 600 retracts the at least two opposite arms of the gripper system to release the waste bin 612. The two opposite arms retract back into a rest position and release the waste bin. The entire gripper system may be located behind bumpers of the fork assembly when in the rest position. The waste bin once released from the two opposite arms can be removed from the fork assembly manually or by driving the front loading WCV away.

In an alternative embodiment, the gripper system has only one moveable arm for grasping the waste bin during lifting and emptying. In one embodiment, the one movable arm includes belting. In an embodiment, the one movable arm may trap the waste bin against a stationary object, such as an added corner, prong, clamp, claw, and/or projection. In another embodiment, the one movable arm may trap the waste bin against any portion of the fork assembly. In one embodiment, the waste container is trapped by the moveable arm and a corner of the fork assembly. In another embodiment, the waste container is trapped by the moveable arm and a fork of the fork assembly. In one embodiment, belting or some other type of gripping surface is added to the stationary object, the fork assembly, and/or a portion of the fork assembly. The stationary object may be any suitable projection, hook, curved and/or bent appendage for holding a waste container with a moveable arm. In one embodiment, the moveable arm and the stationary object securely hold the waste container during lifting and emptying. In another embodiment, the moveable arm and a portion of the fork assembly securely hold the waste container during lifting and emptying.

The above specification provides a complete description of the present invention. Since many embodiments of the invention can be made without departing from the spirit and scope of the invention, certain aspects of the invention reside in the claims hereinafter appended.

What is claimed is:

1. An automated gripper system comprising:

a mounting plate configured to be retrofitted via a permanent attachment to a fork tube that connects two forks of a fork assembly, the two forks for engaging a commercial waste container;

a frame attached to the mounting plate; and at least two opposite movable arms attached to the frame, the at least two opposite movable arms move toward each other upon actuation, each of the at least two opposite movable arms comprising belting attached to the movable arms to securely hold a waste bin, wherein when the mounting plate is retrofitted to the fork tube, the at least two opposite movable arms are positioned in a rest position until actuation of the movable arms to allow the fork assembly to selectively engage the commercial waste container and the waste bin without requiring any repositioning of the at least two opposite movable arms into the rest position, and wherein when the mounting plate is retrofitted to the fork tube, the at least two opposite movable arms are configured to engage and lift the waste bin when the waste bin is both positioned anywhere between the two forks and the waste bin is within a distance of at most 24 inches from the at least two opposite movable arms.

2. The gripper system of claim 1, further comprising a bumper attached to a side of the frame opposite the fork tube.

3. The gripper system of claim 1, further comprising a connector for connecting the gripper system to a power system of a waste collection vehicle.

4. The gripper system of claim 1, further comprising a connector for connecting the gripper system to a hydraulic system of a waste collection vehicle.

5. The gripper system of claim 1, further comprising a connector for connecting the gripper system to a pneumatic system of a waste collection vehicle.

6. The gripper system of claim 1, wherein the belting is made of rubber.

7. The gripper system of claim 1, wherein the at least two opposite movable arms are attached to each other by a link bar assembly.

8. The gripper system of claim 1, wherein the gripper system is a self powered system.

9. The gripper system of claim 1, wherein the waste bin includes non-containerized waste.

10. The gripper system of claim 1, wherein the frame has a depth that is equal to or less than a space between the fork tube and the commercial waste container when the commercial waste container is engaged by the fork assembly.

11. The gripper system of claim 10, wherein the at least two opposite movable arms are located within the depth of the frame when in the rest position.

12. The gripper system of claim 11, wherein the depth of the frame is in a range from 9.75 inches to 14.75 inches.

13. The gripper system of claim 1, wherein the at least two opposite movable arms are located within a depth of the frame when in the rest position.

14. The gripper system of claim 1, wherein the at least two opposite movable arms rotate from the rest position about an axis in a direction towards each other and away from the fork tube.

15. A front loading waste collection vehicle comprising:

a hopper attached to a vehicle;

a fork assembly attached to the vehicle, the fork assembly including a fork tube connecting two forks for engaging a commercial waste container; and an automated gripper system retrofitted to the fork assembly, the gripper system comprising:

a mounting plate attached to the fork tube of the fork assembly wherein the mounting plate is retrofitted to the fork tube of the fork assembly;

a frame attached to the mounting plate; and at least two opposite movable arms attached to the frame, the movable arms move toward each other upon actuation, each of the at least two opposite movable arms comprising belting attached to the movable arms to securely hold a waste bin, wherein the at least two opposite movable arms are positioned in a rest position until actuation of the movable arms to allow the fork assembly to selectively engage the commercial waste container and the waste bin without requiring any repositioning of the least two opposite movable arms into the rest position, and wherein the at least two opposite movable arms are configured to engage and lift the waste bin when the waste bin is both positioned anywhere between the two forks and the waste bin is within a distance of at most 24 inches from the at least two opposite movable arms.

16. The front loading waste collection vehicle of claim 15, further comprising:

at least one bumper attached to the fork assembly, the at least one bumper adapted to contact the commercial waste container when loaded on the fork assembly, wherein the gripper system is positioned behind the at least one bumper on the fork assembly.

17. The front loading waste collection vehicle of claim 15, further comprising:

at least one bumper attached to the fork assembly, the at least one bumper adapted to contact the commercial waste container when loaded on the fork assembly, wherein the gripper system is positioned to contact the commercial waste container when loaded on the fork assembly.

18. The front loading waste collection vehicle of claim 15, wherein the at least two opposite movable arms powered by a hydraulic system of the vehicle and connected to each other with a link bar assembly are configured to lift 1000 pounds.

19. The front loading waste collection vehicle of claim 15, wherein the frame has a depth that is equal to or less than a space between the fork tube and the commercial waste container when the commercial waste container is engaged by the fork assembly, and wherein the at least two opposite movable arms are located within the depth of the frame when in the rest position.

20. An automated gripper system comprising:

a mounting plate configured to be retrofitted via a permanent attachment to a fork tube, the fork tube connects two forks of a fork assembly for engaging a commercial waste container;

a frame attached to the mounting plate; and at least two opposite movable arms attached to the frame, the movable arms move toward each other upon actuation, each of the at least two opposite movable arms comprising belting to securely hold a waste bin, the at least two opposite movable arms are located within a depth of the frame when in a rest position, and the at least two opposite movable arms rotate from the rest position about an axis in a direction towards each other and away from the fork tube, wherein when the mounting plate is retrofitted to the fork tube, the at least two opposite movable arms are structured to and positioned in the rest position until actuation of the at least two opposite movable arms to allow the fork assembly to selectively engage the commercial waste container and the waste bin without requiring any repositioning of the at least two opposite movable arms into the rest position, and wherein when the mounting plate is retrofitted to the fork tube, the at least two opposite movable arms are structured and positioned to engage and lift the waste bin in any position between the two forks and in any orientation when the waste bin is within a distance of at most 24 inches from the at least two opposite movable arms.

* * * * *